US008887621B2

(12) United States Patent
Ohata et al.

(10) Patent No.: US 8,887,621 B2
(45) Date of Patent: Nov. 18, 2014

(54) RECIPROCATING COMPRESSOR

(75) Inventors: Akito Ohata, Yokohama (JP); Hisatoshi Kobayashi, Yokohama (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 879 days.

(21) Appl. No.: 13/039,718

(22) Filed: Mar. 3, 2011

(65) Prior Publication Data

US 2011/0247486 A1 Oct. 13, 2011

(30) Foreign Application Priority Data

Apr. 7, 2010 (JP) ..... 2010-088605

(51) Int. Cl.
*F16J 9/00* (2006.01)
*F04B 39/00* (2006.01)

(52) U.S. Cl.
CPC ..... *F04B 39/0016* (2013.01)
USPC ..... 92/240; 92/249

(58) Field of Classification Search
CPC ..... F04B 39/00; F04B 39/02; F04B 35/00; F04B 35/002; F04B 27/08
USPC ..... 92/240, 249, 256, 257
See application file for complete search history.

(56) References Cited

U.S. PATENT DOCUMENTS

| | | | | | |
|---|---|---|---|---|---|
| 3,759,148 | A * | 9/1973 | Geffroy | | 92/160 |
| 4,396,363 | A * | 8/1983 | Sakamaki et al. | | 417/439 |
| 4,540,352 | A | 9/1985 | Becker | | |
| 5,064,359 | A * | 11/1991 | Plummer | | 417/489 |
| 5,378,123 | A * | 1/1995 | Scuderi et al. | | 417/415 |
| 6,073,538 | A | 6/2000 | Tomesani | | |
| 6,183,211 | B1 * | 2/2001 | Wood | | 417/254 |
| 7,980,831 | B2 * | 7/2011 | Miyake et al. | | 417/326 |
| 8,430,650 | B2 | 4/2013 | Ohata et al. | | |

FOREIGN PATENT DOCUMENTS

| | | | | |
|---|---|---|---|---|
| CN | 1185529 A | | 6/1998 | |
| CN | 2893215 Y | | 4/2007 | |
| CN | 201193698 Y | * | 2/2009 | F16J 9/14 |
| CN | 101900098 A | | 12/2010 | |
| JP | 59-136586 A | | 8/1984 | |
| JP | 63-12669 A | | 1/1988 | |
| JP | 5-65877 A | | 3/1993 | |

(Continued)

OTHER PUBLICATIONS

Japanese-language Office Action dated Apr. 9, 2013 (Two (2) pages).

(Continued)

*Primary Examiner* — Edward Look
*Assistant Examiner* — Daniel Collins
(74) *Attorney, Agent, or Firm* — Crowell & Moring LLP

(57) ABSTRACT

A reciprocating compressor including an oscillation-type piston mechanism is provided with a piston ring which is mounted in a piston ring groove to seal a space between a piston and a cylinder. A ring groove other than the piston ring groove is provided at an outer periphery of the piston on a side away from the piston ring groove and closer to a crank shaft. A guide ring, which is inhibited from radial movement and shaped like a skirt opened toward the crank shaft, is mounted in the ring groove. Thus, the oscillation-type reciprocating compressor is adapted to maintain long-term durability even under high-pressure compression condition and to prevent heat propagation to a large end portion.

20 Claims, 17 Drawing Sheets

(56) References Cited

FOREIGN PATENT DOCUMENTS

| | | | | | |
|---|---|---|---|---|---|
| JP | 5-502712 | A | | 5/1993 | |
| JP | 2004-125159 | A | | 4/2004 | |
| JP | 2006-152960 | A | | 6/2006 | |
| JP | 2007-032532 | | * | 2/2007 | ..... F04B 39/00 |
| JP | 2007-32532 | A | | 2/2007 | |
| JP | 2008-297924 | A | | 12/2008 | |
| JP | 5-65877 | B2 | | 11/2012 | |

OTHER PUBLICATIONS

Chinese Office Action with English translation thereof dated May 30, 2013 {Eleven (11) pages}.

* cited by examiner

RECIPROCATING COMPRESSOR

CLAIMS OF PRIORITY

The present application claims priority from Japanese patent application serial no. JP2010-088605, filed on Apr. 7, 2010, the content of which is hereby incorporated by reference into this application.

BACKGROUND OF THE INVENTION

The present invention relates to a reciprocating compressor. More particularly, the invention relates to an oscillation-type reciprocating compressor with oscillating piston in cylinder, that is easy to assemble and can maintain long-term durability even under high-pressure compression condition.

The reciprocating compressors have been used in various fields because they have a simpler structure than other gas compressors and are capable of high-pressure compression.

The reciprocating compressor includes a type (piston type) wherein a piston and a connecting rod are rotatably interconnected by a bearing mechanism as shown in FIG. 7 of JP-A No. 2008-297924, and an oscillation type wherein a piston rod and an upper compressing portion of a piston are formed in one piece as disclosed in JP-A No. 2006-152960.

The reciprocating compressor features a compact simple mechanism that can provide high-pressure compression and is now seeing an increasing user demand for higher performance and compression to higher pressure.

By the way, the oscillation-type reciprocating compressor disclosed in JP-A No. 2006-152960 has an advantage of being easy to assemble and reduced in manufacture costs because of the structure wherein a piston ring is mounted to the upper part of the piston. However, this compressor has a problem that the rotating piston is displaced out of axial alignment with a cylinder when the piston forms a large oscillation angle to the cylinder (see FIG. 6 of JP-A No. 2006-152960).

The piston ring is designed to accommodate such displacement. In the case of high-pressure compression, however, the piston rubs against an inside wall of the cylinder, worsening the problem of piston ring and cylinder scuffing.

As compared with the reciprocating compressor having the piston structure as shown in FIG. 7 of JP-A No. 2008-297924, such an oscillation-type reciprocating compressor has disadvantages of the simple structure of the compressing portion of the piston, a small proportion of metal portion and aptitude to heat propagation to a large end portion (rotary shaft).

In contrast to the piston-type compressor, the oscillation-type reciprocating compressor does not have a rider ring. During compression operation, therefore, the piston ring receives a greater lateral pressure than in the piston-type compressor and thence, is prone to failure or deformation.

During the compression operation, the oscillation-type reciprocating compressor may be decreased in performance due to seal failure of an abutment-joint portion of the piston ring. The seal failure may occur when the abutment-joint portion of the rotating piston ring is aligned in an oscillation direction.

The above-described problems are particularly serious at a high-pressure compression side of a multi-stage compressor.

The present invention is directed to solution to the above problems and has an object to provide an oscillation-type reciprocating compressor that can maintain high performance and long-term durability even under high-pressure compression condition and can prevent heat propagation to the large end portion.

SUMMARY OF THE INVENTION

A reciprocating compressor according to the present invention is a reciprocating compressor that has an oscillation-type piston mechanism and is provided with a piston ring which is mounted in a piston ring groove in order to seal space between the piston and the cylinder. At an outer periphery of the piston, a ring groove other than the piston ring groove is formed on a side away from the piston ring groove and closer to a crank shaft. A guide ring inhibited from radial movement is mounted in the ring groove.

Desirably, the guide ring is shaped like a skirt opened toward the crank shaft.

A leak cut piston ring wherein an abutment-joint clearance on an inner peripheral side thereof is not communicated with an abutment-joint clearance on an outer peripheral side thereof is employed as the piston ring.

The piston ring has its ring receiving end rounded off in order that the piston ring may not receive lateral pressure on an edge thereof.

DESCRIPTION OF THE PREFERRED EMBODIMENTS

The embodiments of the present invention will be described as below with reference to FIG. 1 to FIG. 19.

Embodiment 1

A first embodiment of the present invention is described as below with reference to FIG. 1 to FIG. 12.

Referring to FIG. 1 to FIG. 7, description is first made on a structure of a reciprocating compressor according to the first embodiment of the invention.

Figure 1:
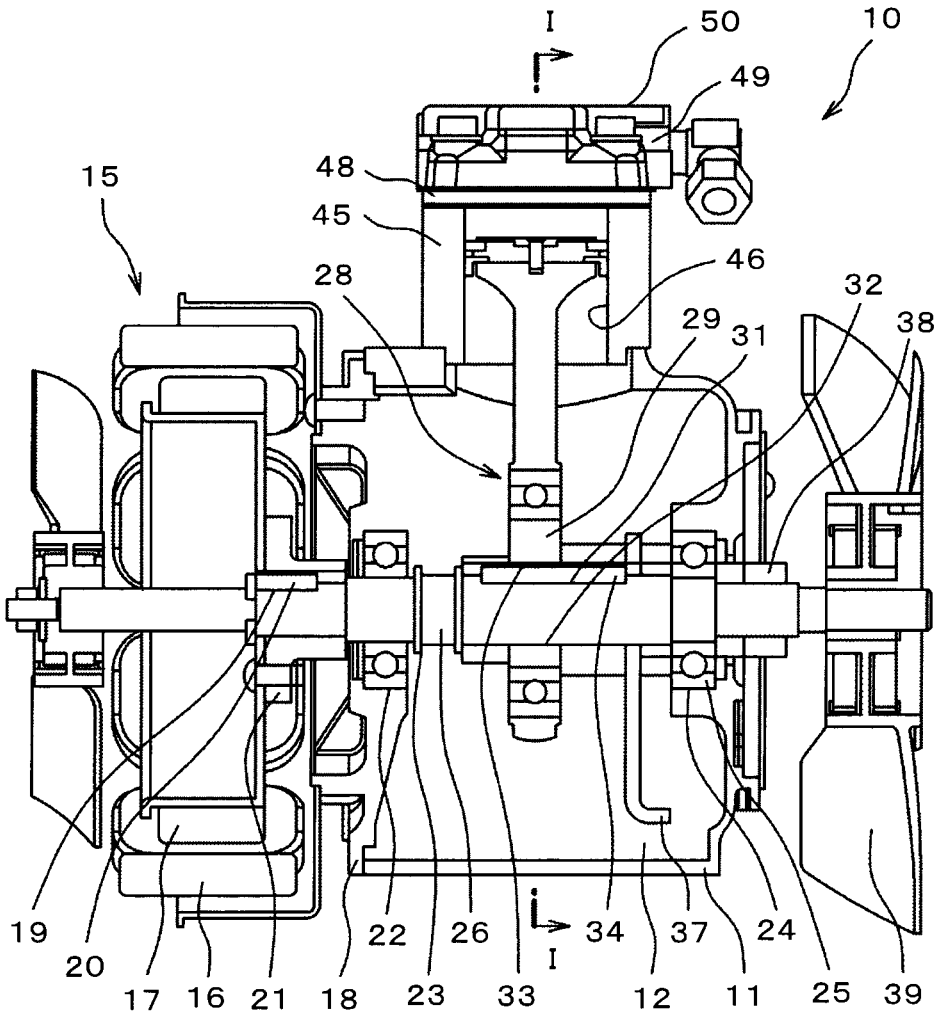
FIG. 1 is a sectional view showing a reciprocating compressor according to a first embodiment of the present invention.

FIG. 1 is a sectional view showing the reciprocating compressor according to the first embodiment of the present invention.

Figure 2:
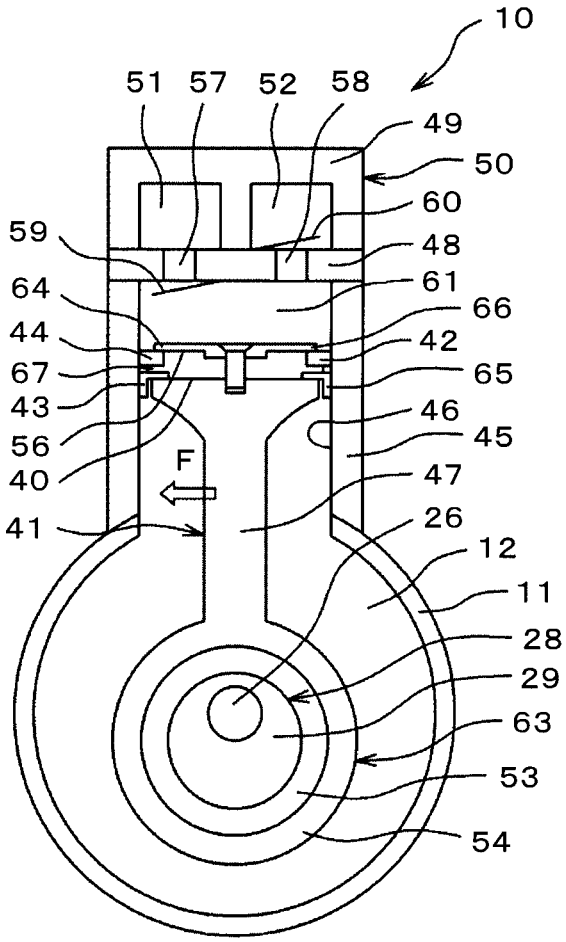
FIG. 2 is a sectional view through I-I in FIG. 1 showing the reciprocating compressor according to the first embodiment.

FIG. 2 is a sectional view through I-I in FIG. 1 showing the reciprocating compressor according to the first embodiment.

Figure 3:
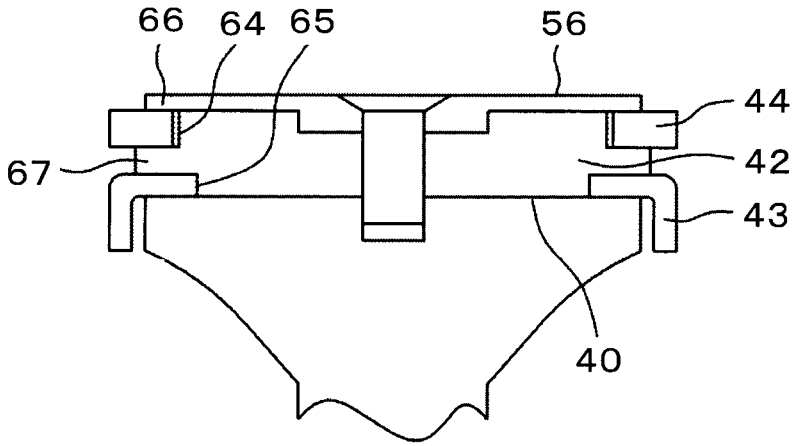
FIG. 3 is an enlarged view showing the vicinity of an upper part of a piston of the reciprocating compressor according to the first embodiment.

FIG. 3 is an enlarged view showing the vicinity of an upper part of a piston of the reciprocating compressor according to the first embodiment.

FIG. 4 is a group of diagrams illustrating a configuration of a piston ring 44.

FIG. 5 is a group of diagrams illustrating a configuration of a guide ring 43.

Figure 6:
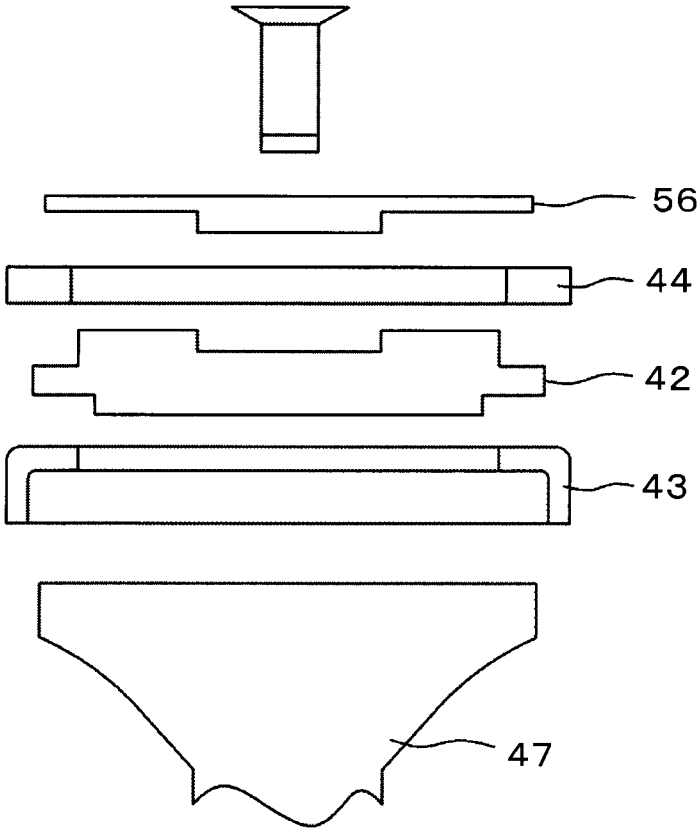
FIG. 6 is an exploded side view showing parts in the vicinity of the upper part of the piston.

FIG. 6 is an exploded side view showing parts in the vicinity of the upper part of the piston.

Figure 7:
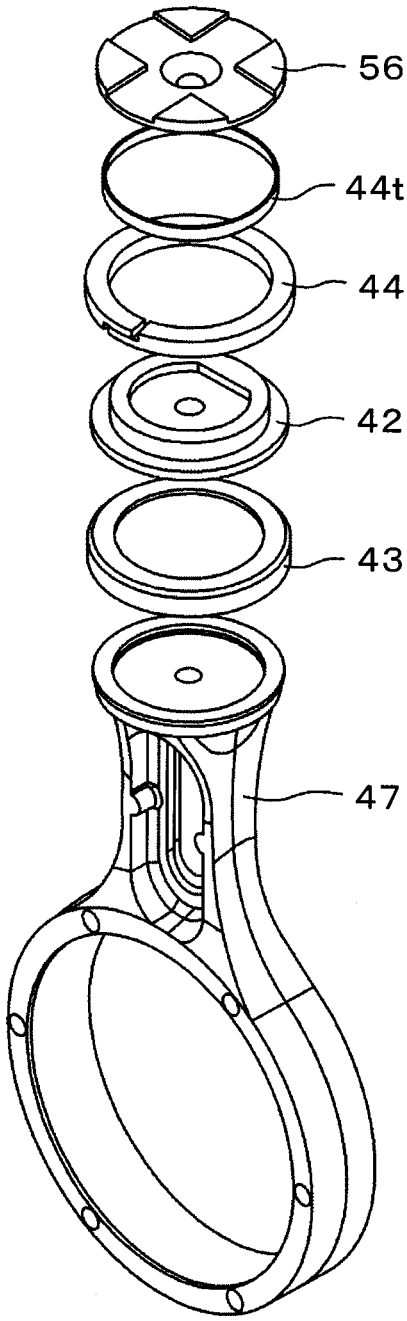
FIG. 7 is an exploded perspective view showing a piston rod 47 and parts thereabove.

FIG. 7 is an exploded perspective view showing a piston rod 47 and parts thereabove.

A reciprocating compressor 10 sucks in gas (fluid) and discharges compressed gas. As shown in FIG. 1 and FIG. 2, the reciprocating compressor 10 includes a crankcase 11, an interior of which defines a crank chamber 12. As shown in FIG. 1, an electric motor 15 is mounted to the crankcase 11. The electric motor 15 includes a stator 16 and a rotor 17. The stator 16 is mounted to a stator holder 18. The rotor 17 is fixed to rotor cap 21 mated with a key 20 fixed to a keyway 19. The rotor cap 21 is fixed to an output shaft 26 supported by a bearing 23 retained by a bearing retainer 22 of a crankcase 11 and a bearing 25 retained by a bearing retainer 24 of the crankcase 11.

The output shaft 26 of the electric motor 15 has one end projecting into the crank chamber 12. Eccentrically fixed to this end of the output shaft 26 is a crank member 29 that constitutes a crank shaft 28 jointly with the output shaft 26 of the electric motor 15. The output shaft 26 is formed with a keyway 31. The crank member 29 is formed with a mating hole 32 which mates with the output shaft 26 in eccentric relation to an outside circumference of the crank member and which is formed with a keyway 33. The crank member 29 is unified with the output shaft 26 by mating a key 34 with these keyways 31, 33. Thus, the crankcase 11 supports the cranks shaft 28 via the bearing 23 and the bearing 25.

A balance weight 37 in abutting contact with the crank member 29 is fixed to the output shaft 26 of the electric motor 15 at place intermediate the length thereof by using a nut 38 threadably mounted on the output shaft 26. A cooling fan 39 is fixed to a distal end of the output shaft 26.

A cylindrical cylinder 45 is mounted atop the crankcase 11 on a proximal end thereof. The cylinder 45 has an inner periphery 46 opening into the crank chamber 12 via a proximal end thereof. Mounted to a distal end of the cylinder 45 is a cylinder head 50 comprising a valve plate 48 and a cylinder head body 49.

As shown in FIG. 2, the cylinder head body 49 is divided into a suction chamber 51 communicated with outside and a discharge chamber 52 communicated with outside.

The valve plate 48 is interposed between the cylinder 45 and the cylinder head body 49. The valve plate 48 is formed with a suction hole 57 for communicating the suction chamber 51 with a compression chamber 61 of the cylinder 45, and a discharge hole 58 for communicating the discharge chamber 52 with the compression chamber 61. A suction valve 59 and a discharge valve 60, as reed valves, are mounted to the valve plate 48. Proximal ends of these suction valve 59 and discharge valve 60 are fixed ends fixed to the valve plate 48 with screws or the like, while distal ends of these valves are free ends for opening and closing the suction hole 57 and the discharge hole 58, respectively.

An oscillating piston 63 is slidably inserted in the cylinder 45. The piston 63 comprises: an oscillating member 41 that includes an annular coupling portion 54 rotatably coupled to the crank member 29 via a bearing 53, the crank member disposed at one end of the piston and eccentrically rotated in the crank chamber 12, a bar-like piston rod 47 integrally extending from the coupling portion 54 in a radial direction thereof and into the cylinder 45, and a disk-like receiving portion 40 coaxially and integrally formed on the opposite side of the piston rod 47 from the coupling portion 54; a disk-like ring retaining member 42 coaxially screwed onto the receiving portion 40 of the oscillating member 41; and a disk-like ring retaining member 56 mated with this ring retaining member 42. The ring retaining member 42 and the ring retaining member 56 are connected to the receiving portion 40 of the oscillating member 41 on the other side of the piston 63 so that the receiving portion and the ring retaining members are oscillatingly reciprocated in the cylinder 45 to define the compression chamber 61 between themselves and the cylinder head 50. The ring retaining members 42, 56 may also be formed in one piece.

An annular piston ring groove 64, radially inwardly recessed, is formed on an outer peripheral side by screwing the ring retaining member 42 and the ring retaining member 56 to the disk-like receiving portion 40. The ring retaining member 42 and the ring retaining member 56 are formed with a flange 66 and a flange 67 in order to form the piston ring groove 64 therebetween. The flange 66 is formed on the opposite side from the piston rod 47 (the side closer to the compression chamber 61) while the flange 67 is formed on the side closer to the piston rod 47. A piston ring 44 for sealing space between the piston 63 and the cylinder 45 is mounted in the piston ring groove 64 formed between the flanges 66, 67.

The piston ring 44 is formed from a resin material excellent in wear resistance and self-lubricability and substantially in an annular shape. The piston ring 44 has a substantially rectangular cross-section and a constant radial width substantially on the overall circumference thereof. The piston ring is circumferentially formed with an abutment-joint portion, which permits the piston ring to be increased or decreased in diameter while maintaining the sealing performance. Furthermore, the piston ring 44 in contact with the inner periphery 46 of the cylinder 45 has a greater inside diameter than the minimum diameter of the piston ring groove 64 as determined when the piston 63 is located at a top dead point or a bottom dead point. This allows the piston ring 44 to move radially relative to the piston 63. The piston ring 44 is also capable of rotation relative to the piston 63 because the piston ring is not so constructed as to be inhibited from rotation.

Figure 4A:
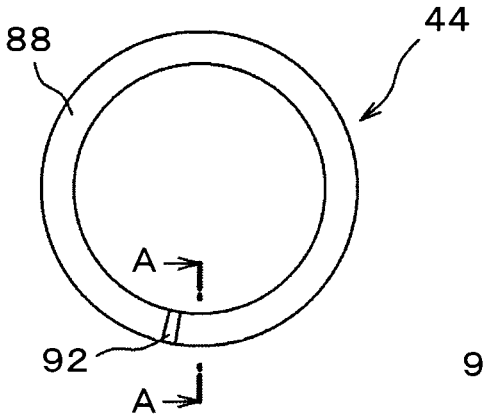
FIG. 4 is a group of diagrams illustrating a configuration of a piston ring 44.
Figure 4C:
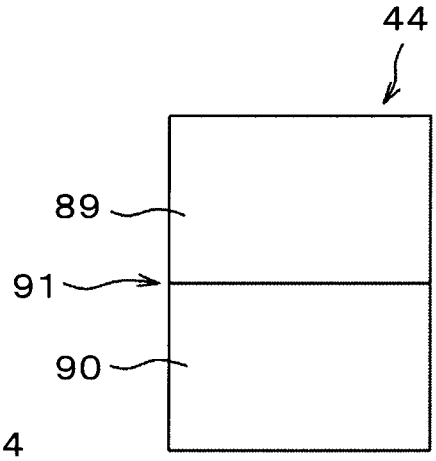
Figure 4B:
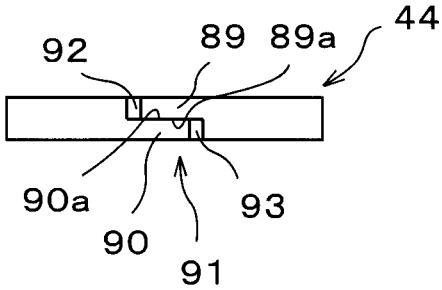

Now, the structure of the piston ring 44 is described in detail with reference to FIG. 4. FIG. 4A is a top view, FIG. 4B is a side view and FIG. 4C is a sectional view through A-A in FIG. 4A.

The piston ring 44 the configuration of which is shown in FIG. 4 is formed of an elastic resin material having excellent wear resistance and self-lubricability and substantially in one annular piece. The piston ring 44 includes: a main annular portion 88 substantially shaped like a circular arc; an arcuate base portion 89 located at one circumferential end of the main annular portion 88 and formed thinner than the main annular portion 88 as shifted to one axial end of the main annular portion 88; and an arcuate base portion 90 located at the other circumferential end of the main annular portion 88 and formed thinner than the main annular portion 88 as shifted to the other axial end of the main annular portion 88. These base portions 89, 90 define abutting surfaces 89*a*, 90*a* which make contact with each other by being mutually displaced in the axial direction of the piston ring 44 and circumferentially overlapping with each other. A combined axial length of these base portions 89, 90 is equal to the axial length of the main annular portion 88.

These base portions 89, 90 constitute an abutment-joint portion 91. The base portions 89, 90 constituting the abutment-joint portion 91 are circumferentially displaced from each other thereby to permit the diametrical expansion and contraction of the piston ring 44. Under natural conditions, the piston ring 44 has a circumferential abutment-joint clearance 92 formed between the base portion 89 at the one circumferential end of the main annular portion 88 and the other circumferential end of the main annular portion 88. A similar abutment-joint clearance 93 is also formed between the base portion 90 at the other circumferential end of the main annular portion 88 and the one circumferential end of the main annular portion 88. When the piston ring 44 is diametrically expanded or contracted, these abutment-joint clearances 92, 93 are expanded or contracted.

Figure 5A:
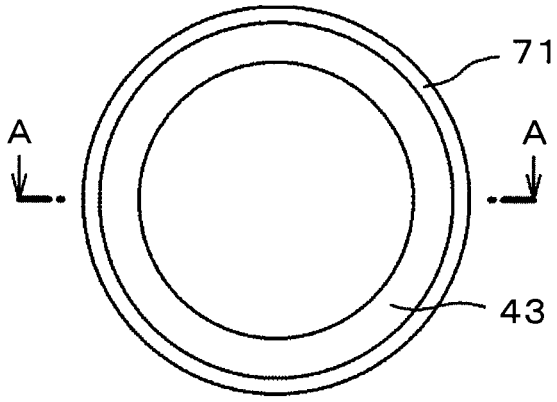
FIG. 5 is a group of diagrams illustrating a configuration of a guide ring 43.
Figure 5B:
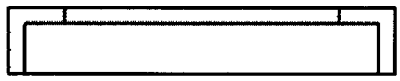

According to the embodiment, an annular guide ring groove 65, radially inwardly recessed, is formed on the outer peripheral side by screwing the ring retaining member 42 to the disk-like receiving portion 40. Mounted in the guide ring groove 65 is a guide ring 43 generally having a disk-like shape and fixing the ring retaining member 42 in axial alignment with the cylinder 45. FIG. 5 shows the configuration of the guide ring 43. FIG. 5A shows the guide ring 43 as viewed from the piston rod 47. FIG. 5B is a sectional view through A-A in FIG. 5A. The guide ring 43 is formed with a skirt 71 for increasing contact area between the guide ring 43 and the inner periphery 46 of the cylinder 45.

FIG. 6 and FIG. 7 show disassembled parts of a piston head to which the piston ring 44 and the guide ring 43 are mounted. A tension ring 44*t* shown in FIG. 7 is fitted in the piston ring 44 such that the piston ring 44 is expanded outward by an expansion force of the ring, thus making close contact with the inner periphery 46 of the cylinder 45.

The coupling portion 54 is driven into the eccentric rotation by the rotating crank member 29 while the piston ring 44 and the guide ring 43 supported by the ring retaining member 42 are slidably guided on the inner periphery 46 of the cylinder 45 whereby the piston 63, with the ring retaining members 42, 56 oscillating in a direction orthogonal to the crank shaft, is reciprocated in the cylinder 45.

Figure 8A:
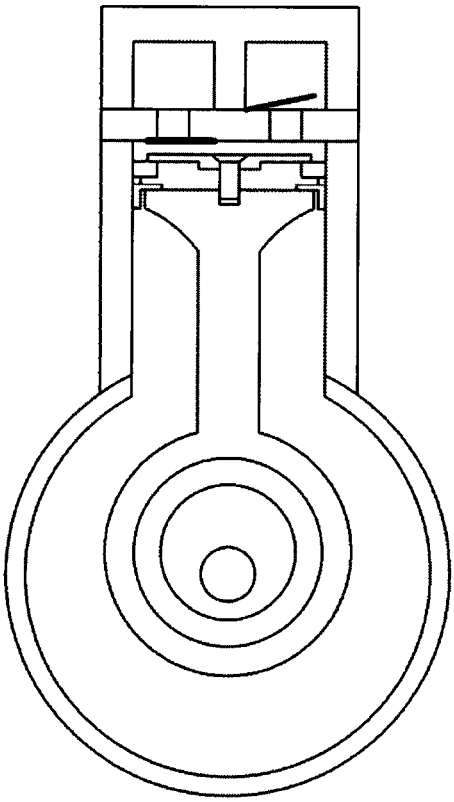
FIG. 8A is a diagram showing a top dead point of the piston.
Figure 8B:
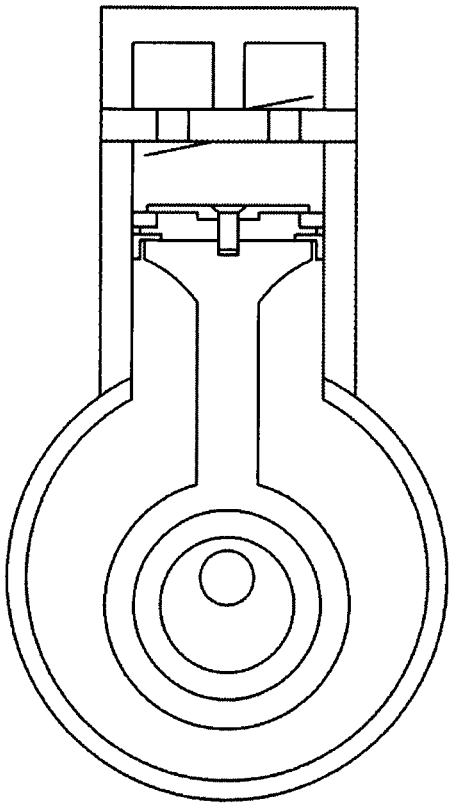
FIG. 8B is a diagram showing a bottom dead point of the piston.
Figure 8C:
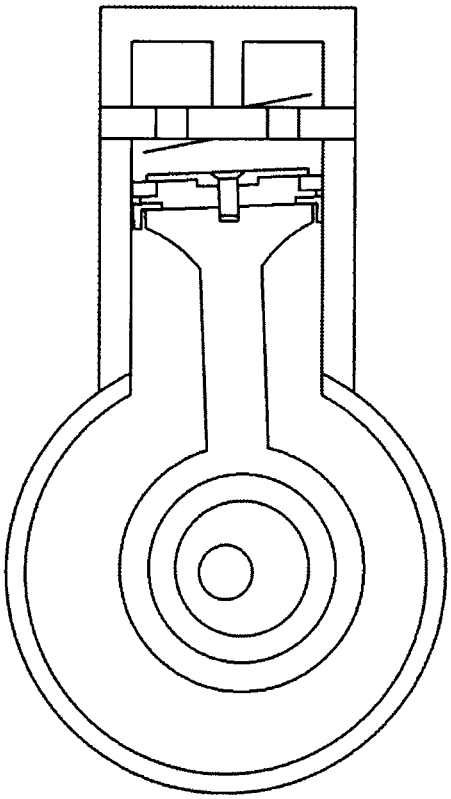
FIG. 8C is a diagram showing the piston forming the maximum oscillation angle to a cylinder.

While the constitution of the reciprocating compressor 10 according to the embodiment is described above, description is now made on the operation thereof with reference to the above figures and FIG. 8A to FIG. 8C.

FIG. 8A is a diagram showing the top dead point of the piston.

FIG. 8B is a diagram showing the bottom dead point of the piston.

FIG. 8C is a diagram showing the piston forming the maximum oscillation angle to the cylinder.

When the electric motor 15 is driven into rotation, the crank member 29 fixed to the output shaft thereof is brought into an eccentric rotary motion. The piston 63 rotatably coupled to the crank member 29 via the bearing 53, in turn, reciprocally moves the ring retaining members 42, 56, the piston ring 44 and the guide ring 43 in the cylinder 45. In a suction step, the ring retaining member 56 and the piston ring 44 are moved away from the piston head 50 to expand the compression chamber 61, so that the suction valve 59 is opened with the discharge valve 60 held closed, thereby introducing gas into the compression chamber 61. In the subsequent compression step, the ring retaining member 56 and the piston ring 44 are moved toward the cylinder head 50 to contract the compression chamber 61, so that the discharge valve 60 is opened with the suction valve 59 held closed, thereby discharging compressed gas from the compression chamber 61 into the discharge chamber 52 in the cylinder head 50.

During the above-described operation, the ring retaining member 56 and the piston ring 44 are oscillatingly reciprocated in the cylinder 45.

When the piston is at the bottom dead point to maximize the compression chamber 61, the piston 63 and the cylinder 45 are axially aligned with each other (FIG. 8B). To carry out the compression step from this state, the crank member 29 rotates counterclockwise so as to move the ring retaining members 42, 56, the piston ring 44 and the guide ring 43 in the direction to contract the compression chamber 61. Meanwhile the coupling portion 54 eccentrically rotates as moving upward to a midpoint between the top dead point and the bottom dead point, where the coupling portion 54 is located closest to the cylinder 45 (FIG. 8C). At this time, the ring retaining members 42, 56 are inclined at the great angle to the center axis of the cylinder 45.

Subsequently when the piston moves to the top dead point, the ring retaining members 42, 56 are subject to the maximum downward force F derived from their own weight and centrifugal force of the oscillation. However, the guide ring 43 inhibits the downward movement of the ring retaining members 42, 56 and hence, the piston ring groove 64 is substantially maintained in coaxial relation with the cylinder 45 while the piston ring 44 is substantially maintained in coaxial relation with the ring retaining member 42. Subsequently when the piston is at the top dead point to minimize the compression chamber 61, the piston 63 and the cylinder 45 are in axial alignment and the compression step ends (FIG. 8A).

When the crank member 29 with the ring retaining member 42 located at the top dead point rotates to carry out the suction step, the piston 63 moves the ring retaining members 42, 56, the piston ring 44 and the guide ring 43 in the direction to expand the compression chamber 61. The coupling portion 54 eccentrically rotates as moving down to a midpoint between the top dead point and the bottom dead point, where the coupling portion 54 is located closest to the cylinder. At this time, the ring retaining member 42 is inclined at the greatest angle to the center axis of the cylinder 45.

As the piston moves toward the bottom dead point, the coupling portion 54 returns to the center. At the bottom dead point to maximize the compression chamber 61, the piston 63 is in axial alignment 63 with the cylinder 45 and the suction step ends.

According to the embodiment as described above, the guide ring inhibits the ring retaining members 42, 56 from being moved downward by the maxim downward force F occurring during the compression step. Therefore, the piston ring groove 64 is substantially maintained in the coaxial relation with the cylinder 45. This ensures that the piston ring 44 is always located centrally on the ring retaining member 42 and hence, the following problem can be obviated. If the piston ring 44 is displaced out of axial alignment with the ring retaining member 42, leakage of compressed air may result. Because of the pressure of the compressed air so leaked, the piston ring 44 may fall off from the ring retaining member 42.

The guide ring 43 is axially aligned with the ring retaining member 42 by mounting the guide ring in the guide ring groove 65 and fixing the guide ring therein with a screw. When the cylinder 45 is assembled to the crankcase 11, the guide ring 43 is in contact with the inner periphery 46 of the cylinder to thereby fix the assembling position of the cylinder 45. Therefore, the cylinder 45 is axially aligned with the ring retaining member 42. This permits the piston ring 44 mounted on the ring retaining member 42 to be centered with respect to the cylinder 45.

In the case of wear-out of the piston ring 44, the guide ring 43 can also prevent the ring retaining members 42, 56 from making contact with the cylinder 45, providing for improvement in failure process of the product.

Furthermore, the conduction of compression heat from the ring retaining member 42 to the piston rod 47 can be prevented by inserting the guide ring 43 between the ring retaining member 42 and the receiving portion 40, the compression heat generated in the compression chamber 61. Therefore, the temperature of the large end portion can be lowered. This permits the bearing 53 to achieve an extended service life.

Figure 9A:
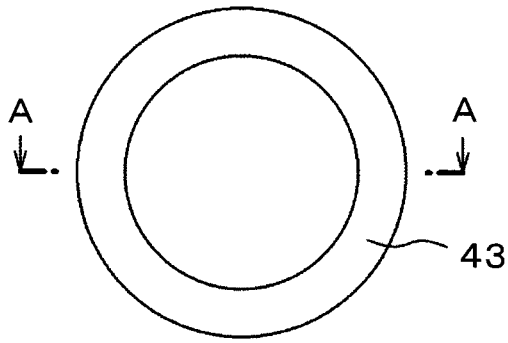
FIG. 9 is a group of diagrams illustrating a configuration of a guide ring according to an exemplary modification 1 of the first embodiment.
Figure 9B:
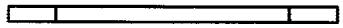
Figure 10:
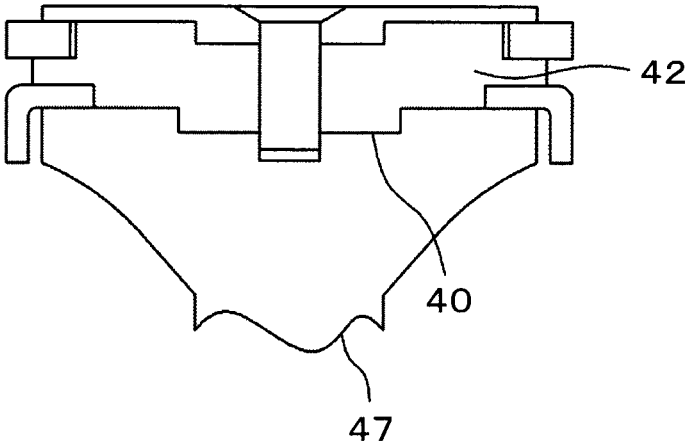
FIG. 10 is an enlarged view showing the vicinity of an upper part of a piston according to an exemplary modification 2 of the first embodiment.
Figure 11:
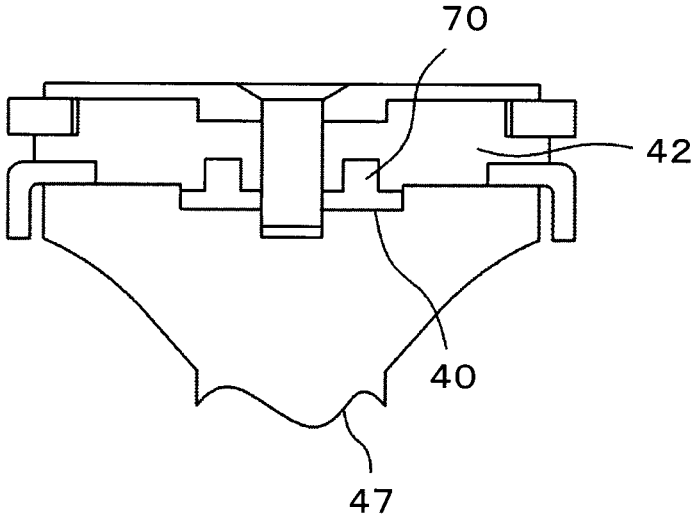
FIG. 11 is an enlarged view showing the vicinity of an upper part of a piston according to an exemplary modification 3 of the first embodiment.

Next, description is made on a variety of exemplary modifications of the first embodiment of the present invention with reference to FIG. 9 to FIG. 11.

FIG. 9 is a group of diagrams illustrating a configuration of a guide ring according to an exemplary modification 1 of the first embodiment of the invention.

FIG. 10 is an enlarged view showing the vicinity of an upper part of a piston according to an exemplary modification 2 of the first embodiment.

FIG. 11 is an enlarged view showing the vicinity of an upper part of a piston according to an exemplary modification 3 of the first embodiment.

Figure 12:
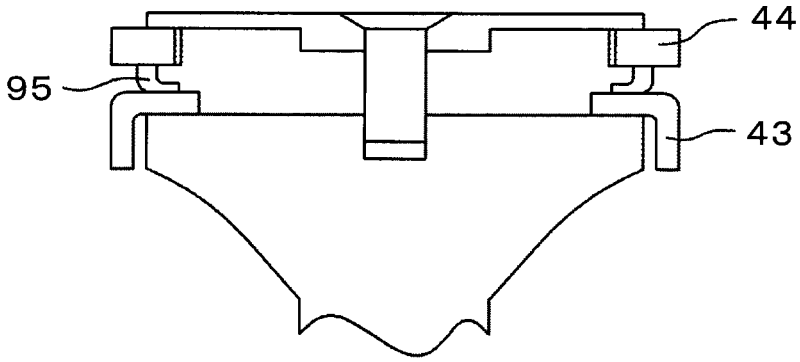
FIG. 12 is an enlarged view showing the vicinity of an upper part of a piston according to an exemplary modification 4 of the first embodiment.

FIG. 12 is an enlarged view showing the vicinity of an upper part of a piston according to an exemplary modification 4 of the first embodiment.

The exemplary modification 1 relates to the configuration of the guide ring 43. The guide ring 43 of the embodiment includes the skirt 71 as shown in FIG. 5. According to the exemplary modification 1, the skirt 71 is removed from the guide ring 43, as shown in FIG. 9. The guide ring has a rectangular cross-section.

The exemplary modification 2 relates to the configuration of the ring retaining member 4 and the receiving portion 40. According to the exemplary modification 2, the receiving portion 40 is stepped, as shown in FIG. 10. The piston rod 47 and the ring retaining member 42 can be axially aligned by mating the ring retaining member 42 with the receiving portion 40.

The exemplary modification 3 is a modified version of the modification 2. That is, a dead-air space 70 is provided between the ring retaining member 42 and the receiving portion 40. The dead-air space 70 can prevent the heat generated by compressed air in the compression chamber 61 from being conducted to the large end portion of the piston rod 47. Therefore, the bearing 53 can achieve the extended service life.

The exemplary modification 4 is provided with a reinforcement plate 95 for supporting the piston ring 44, as shown in FIG. 12. This reinforcement plate 95 can support the piston ring 44 rigidly to obviate the oscillation thereof and can also fix the guide ring 43 firmly.

Embodiment 2

A second embodiment of the present invention will be described as below with reference to FIG. 13 to FIG. 15.

While the first embodiment illustrates one-stage compression as the compression step, this embodiment illustrates two-stage compression as the compression step.

Figure 13:
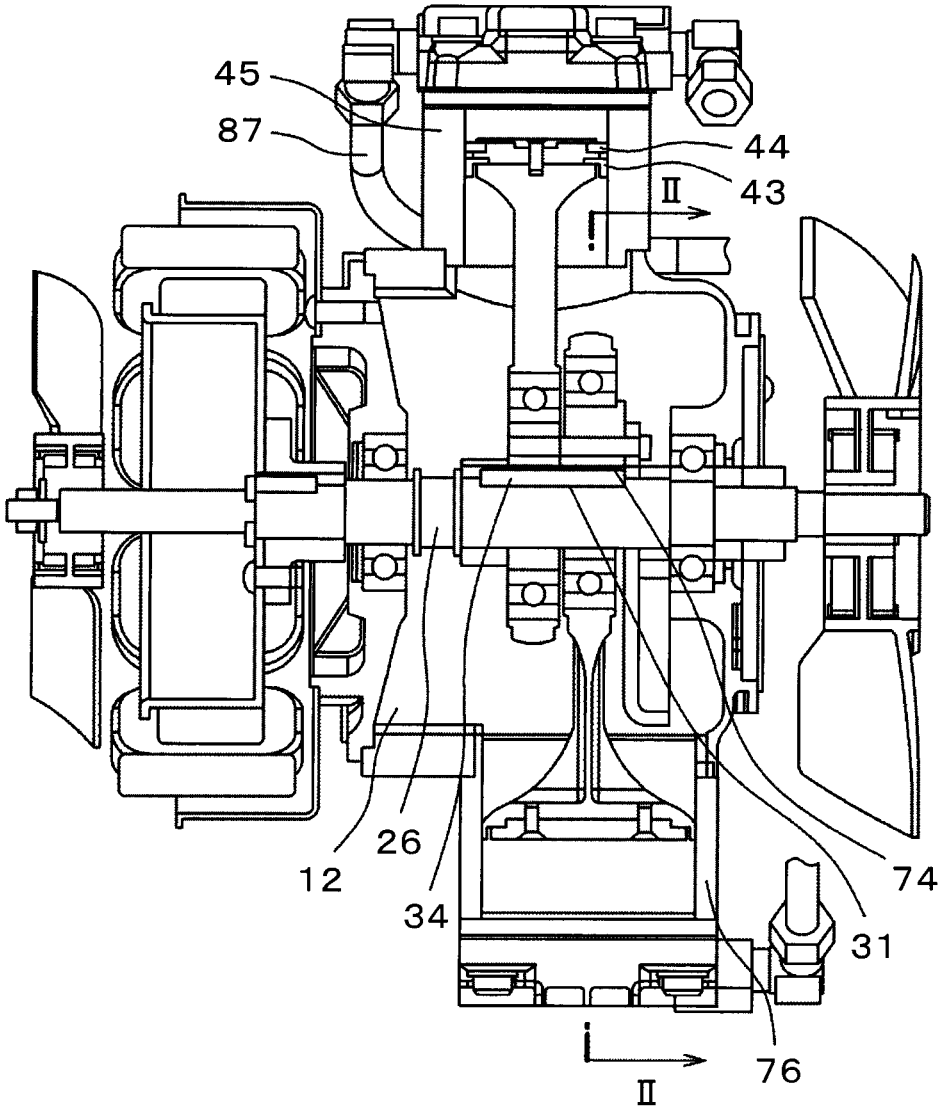
FIG. 13 is a sectional view showing a reciprocating compressor according to a second embodiment of the present invention.

FIG. 13 is a sectional view showing a reciprocating compressor according to a second embodiment of the present invention.

Figure 14:
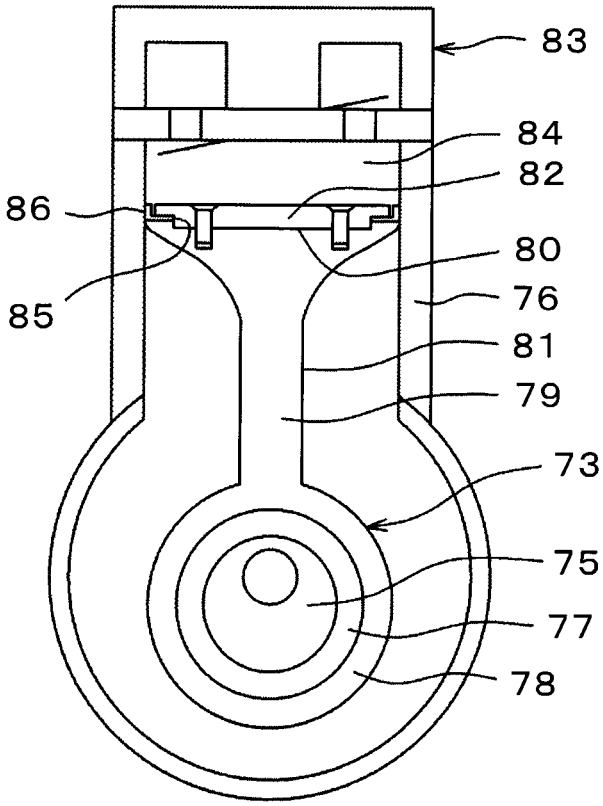
FIG. 14 is a sectional view through II-II in FIG. 13 showing the reciprocating compressor according to the first embodiment.

FIG. 14 is a sectional view through II-II in FIG. 13 showing the reciprocating compressor according to the second embodiment.

Figure 15:
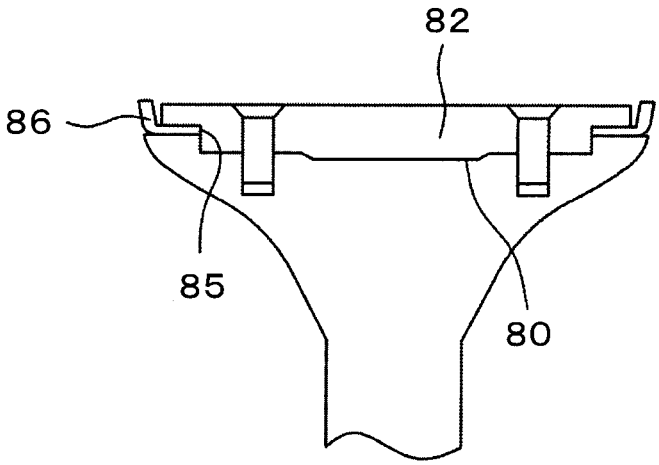
FIG. 15 is an enlarged view showing the vicinity of an upper part of a piston of the reciprocating compressor according to the second embodiment.

FIG. 15 is an enlarged view showing the vicinity of an upper part of a piston of the reciprocating compressor according to the second embodiment of the invention.

As shown in FIG. 13, the output shaft 26 of the reciprocating compressor of this embodiment is mounted with a piston 73 including a lip ring 86 in addition to the piston 63 having the piston ring 44 and the guide ring 43 fixed in the piston ring groove 64 and the guide ring groove 65. The piston 73 has a crank member 73 unified with the output shaft 26 by mating the key 34 with a keyway 74 formed in the crank member 75 and with the keyway 31 formed in the output shaft 26.

The oscillating piston 73 is slidably inserted in a cylinder 76. The piston 73 comprises: an oscillating member 81 that includes an annular coupling portion 78 rotatably coupled to the crank member 75 via a bearing 77, the crank member disposed at one end of the piston and eccentrically rotated in the crank chamber 12, a bar-like piston rod 79 integrally extending from the coupling portion 78 in a radial direction thereof and into the cylinder 76, and a disk-like receiving portion 80 coaxially and integrally formed on the opposite side of the piston rod 47 from the coupling portion 78; and a disk-like ring retaining member 82 coaxially screwed onto the receiving portion 80 of the oscillating member 81. The receiving portion 80 and the ring retaining member 82 are connected to the oscillating member 81 on the other end of the piston 73 so that the receiving portion and the ring retaining member are oscillatingly reciprocated in the cylinder 76 to define a compression chamber 84 between themselves and a cylinder head 83. The lip ring 86 is mounted in a lip ring groove 85 formed between the ring retaining portion 82 and the receiving portion 80. The operation of the compression step is performed the same way as in the first embodiment.

According to this embodiment, a primary compression is performed by the piston 73 including the lip ring 86 and the compressed air is fed into the cylinder 45 through a pipe 87. In the cylinder 45, a secondary compression is performed by the piston 63 including the piston ring 44 and the guide ring 43. A principal part of the piston 73 including the lip ring 86 is shown in enlarged dimension in FIG. 15.

As described above, the embodiment is adapted for the two stage compression that uses the oscillating pistons advantageous in terms of cost for carrying out both the first stage compression and the second stage compression. Thus, the embodiment can provide an effective air compression.

Next, exemplary modifications of this embodiment are described as below.

The two-stage compressor may have a structure wherein the piston ring 44 is employed for the first stage compression.

An alternative structure may be made wherein both the first stage compression and the second stage compression are performed by the pistons 63 including the piston rings 44 and the guide rings 43. Although the structure employing the piston ring 44 requires higher manufacture cost, the structure using the piston ring 44 can compress air to higher pressure than the structure using the lip ring 86. Hence, the structure employing the piston ring 44 can compress air to higher pressure in the first stage compression, contributing to the increase in compression efficiency. The compressor as a whole can achieve air compression to even higher pressure.

Embodiment 3

A third embodiment of the present invention will be described as below with reference to FIG. 16 to FIG. 19.

The third embodiment illustrates the details of a high-pressure compression portion of the multi-stage compressor described in the second embodiment.

Figure 16:
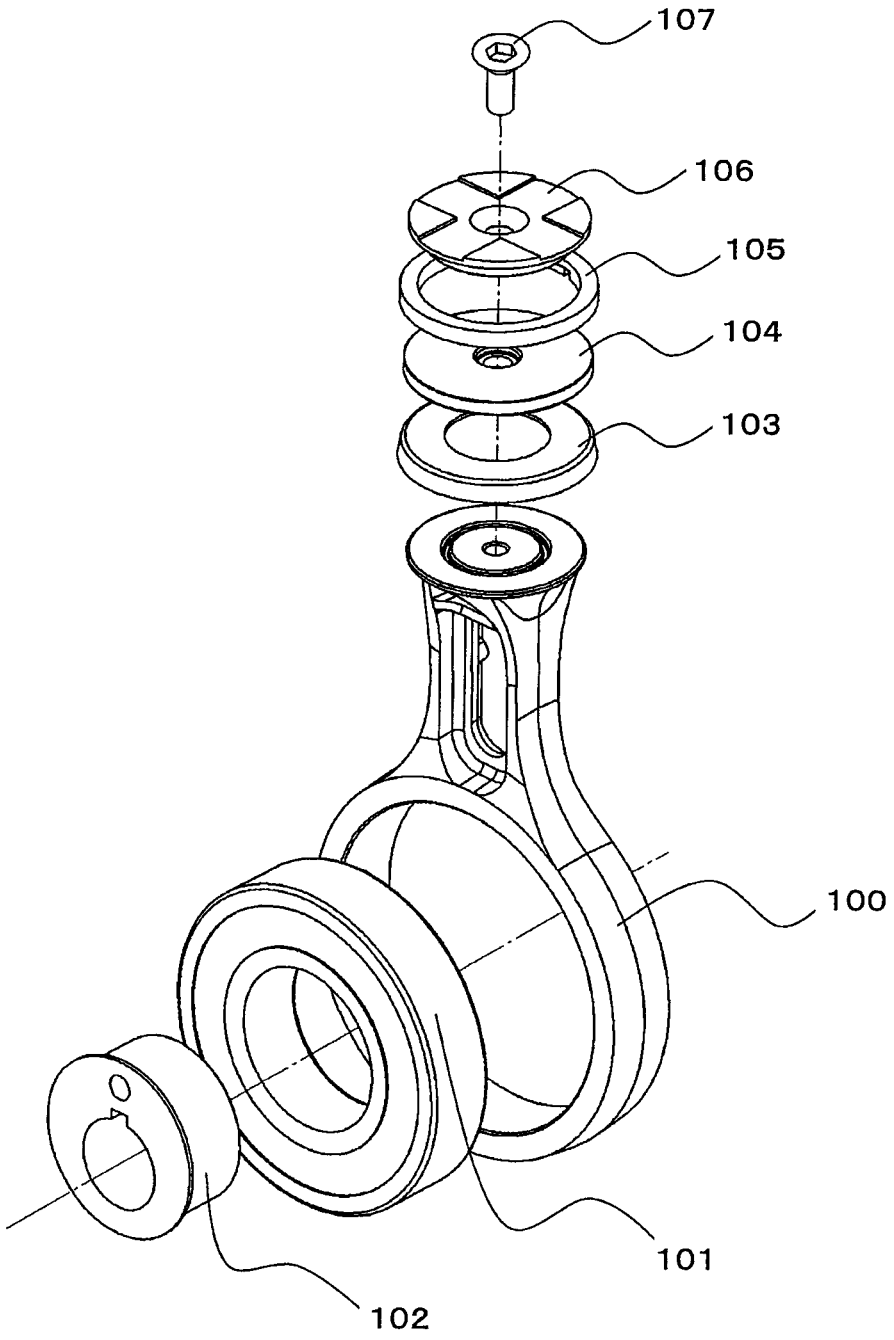
FIG. 16 is an exploded perspective view showing a compression portion according to a third embodiment of the present invention.

FIG. 16 is an exploded perspective view showing a compression portion according to the third embodiment of the present invention.

Figure 17:
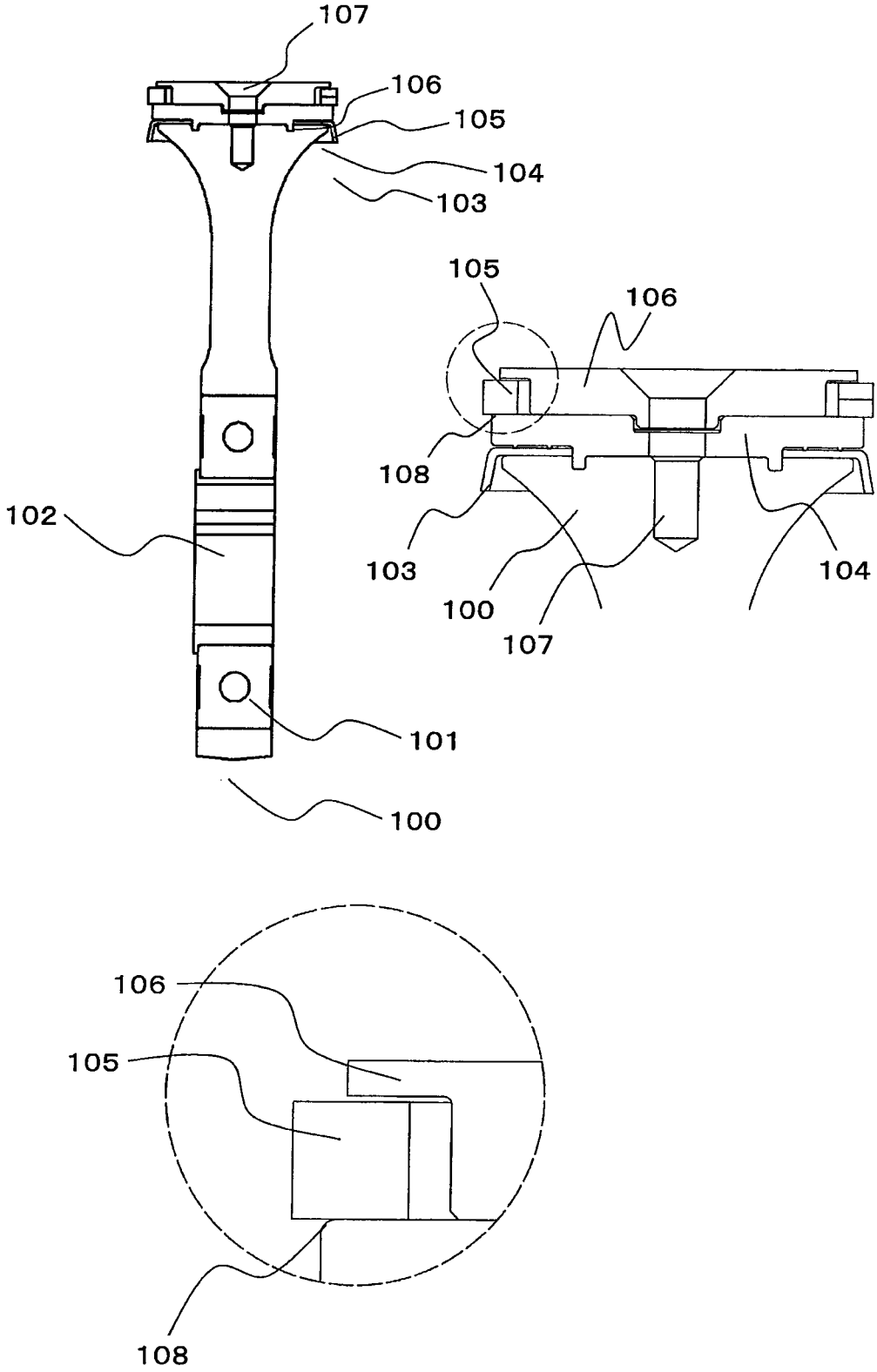
FIG. 17 is a group of fragmentary detailed views showing the compression portion of a reciprocating compressor according to the third embodiment.

FIG. 17 is a group of fragmentary detailed views showing the compression portion of a reciprocating compressor according to the third embodiment of the invention.

Figure 18:
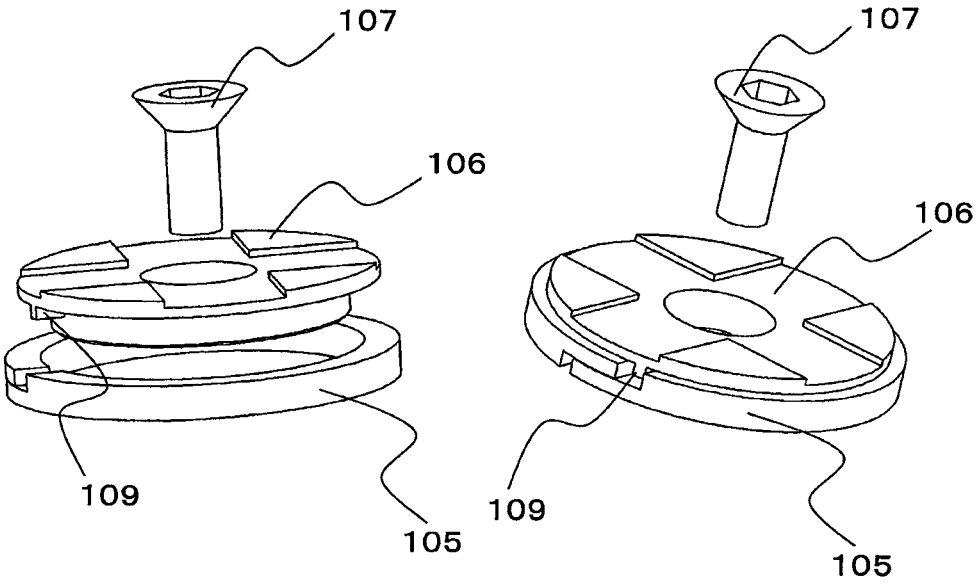
FIG. 18 is a group of perspective views showing a detent according to the third embodiment.

FIG. 18 is a group of perspective views showing a detent according to the third embodiment of the invention.

Figure 19:
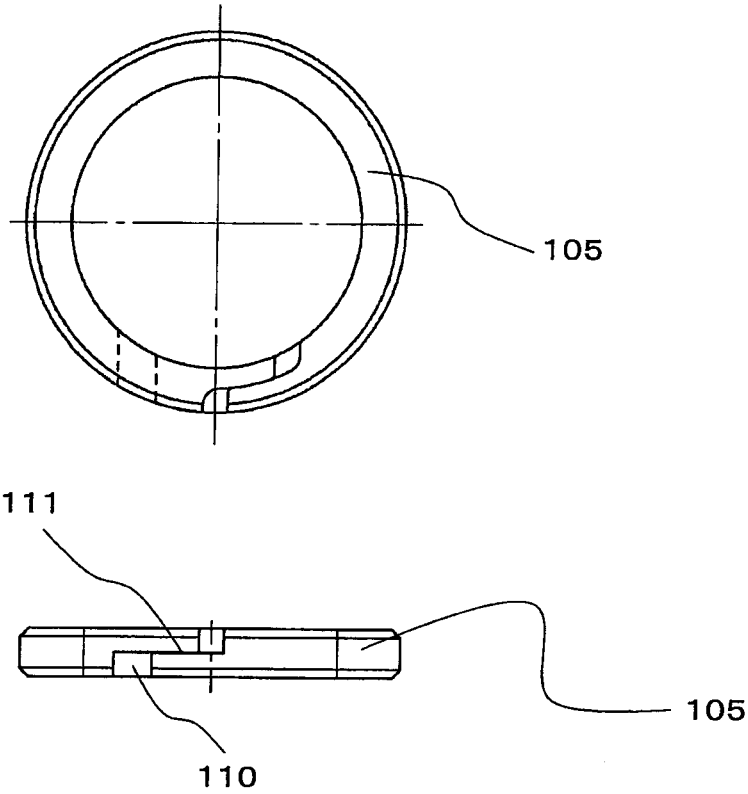
FIG. 19 is a group of diagrams showing a high rigid piston ring according to the third embodiment.

FIG. 19 is a group of diagrams showing a high rigid piston ring according to the third embodiment of the invention.

In the high-pressure compression portion of the multi-stage compressor of this embodiment, a bearing 101 is shrink-fitted in a connecting rod 100, while a crank member 102 is press-inserted in the bearing 101, as shown in FIG. 16. A guide ring 103, a piston ring retaining member 104, a piston ring 105, and a piston ring retaining member 106 are assembled to the connecting rod 100 in the order named and fixed together with a screw 107.

A leak cut piston ring as shown in FIG. 19 is used as the piston ring 105. The leak cut piston ring has a structure wherein base portions overlap with each other in axial and radial directions of the ring. Specifically, when the ring expands, abutment-joint clearances are formed on inner peripheral side and outer peripheral side of the ring. However, these abutment-joint clearances are not communicated with each other because they are formed at places out of alignment.

Since the leak cut piston ring 105 has the structure wherein the abutment-joint clearance on the inner peripheral side thereof is not communicated with the abutment-joint clearance on the outer peripheral side, back pressure applied on the piston ring 105 cannot leak through the inner periphery of the ring. This negates the need for the tension ring 44*t* cited in the description of the first embodiment.

As shown in FIG. 17, a ring receiving end 108 of the ring retaining member 106 is rounded off or removed of edge.

As shown in FIG. 18, the ring retaining member 106 is formed with a projection 109 which is fitted in a ring cut-away portion (abutment-joint clearance) 110 of the piston ring 105.

According to the embodiment as described above, the leak cut piston ring 105 has the structure wherein the abutment-joint clearance on the inner peripheral side thereof is not communicated with the abutment-joint clearance on the outer peripheral side thereof and hence, the back pressure on the piston ring 105 cannot leak through the inner periphery thereof. This negates the need for the tension ring 44*t* cited in the description of the first embodiment. Accordingly, the embodiment holds promise for cost reduction and improved assemblability.

The following problem can be obviated by rounding off the ring receiving end 108 of the ring retaining member 104. In the above-described compression step, the piston ring 105 is prevented from being deformed or broken by the pressure of the compressed air or by the lateral pressure applied to the ring being slidably moved. If the ring receiving end 108 has the edge, the above forces are applied to the piston ring 105 from the ring receiving end 108, resulting in stress concentration. However, stress concentration on the ring receiving end 108 can be prevented by rounding off the end.

The ring retaining member 106 is formed with the projection 109, which is fitted in the abutment-joint clearance 110 of the piston ring 105. This arrangement allows the ring retaining member 106 fixed to the connecting rod 100 to serve as a detent for the piston ring 105. The piston ring 105 inhibited from rotation can prevent an abutment-joint portion 111 of the piston ring 105 from being aligned in the oscillation direction, so that the piston ring 105 is not lowered in sealing performance at the abutment-joint portion 111 thereof. Thus, the piston ring 105 is prevented from suffering performance degradation.

Effects of Present Invention Appreciable from the Embodiments

As apparent from the above embodiments, the present invention can provide the oscillation-type reciprocating compressor that can maintain high performance and long-term durability even under high-pressure compression condition and can prevent heat propagation to the large end portion.

What is claimed is:

1. A reciprocating compressor comprising:

a cylinder and a piston one end of which defines a coupling portion rotatably coupled to a crank shaft and the other end of which is oscillatingly reciprocated in the cylinder;

a piston ring groove disposed at an outer periphery of the piston; and a piston ring mounted in the piston ring groove and sealing a space between the piston and the cylinder, wherein a ring groove other than the piston ring groove is provided at the outer periphery of the piston on a side away from the piston ring groove and closer to the crank shaft, a guide ring is mounted in the ring groove in such a manner that the guide ring cannot move radially, within the ring groove, from an initial guide ring position, to thereby suppresses radial movement of the piston when the piston is tilted with respect to the cylinder, and the initial guide ring position is a radial position at which the guide ring is installed in the ring groove between the piston and the cylinder.

2. The reciprocating compressor according to claim 1, wherein the piston ring is formed to include an abutment joint portion and to be capable of diametrical expansion and contraction.

3. The reciprocating compressor according to claim 1, wherein the guide ring includes a skirt opened toward the crank shaft.

4. The reciprocating compressor according to claim 1, wherein a reinforcement plate is fixed between the piston ring and the guide ring.

5. The reciprocating compressor according to claim 1, wherein the piston ring and the guide ring are retained by a ring retaining member disposed at a distal end of the piston that includes a receiving portion for supporting the ring retaining member, and wherein the ring retaining member and the receiving portion are each formed with a step and mated together via the steps.

6. The reciprocating compressor according to claim 5, wherein a dead air space is provided between the ring retaining member and the receiving portion.

7. A reciprocating compressor comprising:

a cylinder and a piston one end of which defines a coupling portion rotatably coupled to a crank shaft and the other end of which is oscillatingly reciprocated in the cylinder;

a piston ring groove disposed at an outer periphery of the piston; and a piston ring mounted in the piston ring groove and sealing a space between the piston and the cylinder, wherein a ring groove other than the piston ring groove is provided at the outer periphery of the piston on a side away from the piston ring groove and closer the crank shaft, and a guide ring is mounted in the ring groove in such a manner that the guide ring is inhibited from any radial movement within the ring groove, to thereby suppresses radial movement of the piston when the piston is tilted with respect to the cylinder.

8. The reciprocating compressor according to claim 7, wherein the piston ring is formed to include an abutment joint portion and to be capable of diametrical expansion and contraction.

9. The reciprocating compressor according to claim 7, wherein the guide ring includes a skirt opened toward the crank shaft.

10. The reciprocating compressor according to claim 7, wherein a reinforcement plate is fixed between the piston ring and the guide ring.

11. The reciprocating compressor according to claim 7, wherein the piston ring and the guide ring are retained by a ring retaining member disposed at a distal end of the piston that includes a receiving portion for supporting the ring retaining member, and wherein the ring retaining member and the receiving portion are each formed with a step and mated together via the steps.

12. The reciprocating compressor according to claim 7, wherein the piston ring is a leak cut piston ring in which an abutment joint clearance on an inner peripheral side thereof is not communicated with an abutment joint clearance on the outer peripheral side thereof.

13. The reciprocating compressor according to claim 7, wherein the piston ring and the guide ring are retained by a ring retaining member and wherein the ring retaining member includes a projection fitted in an abutment joint clearance of the piston ring.

14. The reciprocating compressor according to claim 7, wherein the piston ring and the guide ring are retained by a ring retaining member and wherein the ring retaining member has an end removed of edge by rounding.

15. The reciprocating compressor according to claim 11, wherein a dead air space is provided between the ring retaining member and the receiving portion.

16. A reciprocating compressor comprising at least two piston and cylinder combinations and operating to compress gas by using a piston-cylinder mechanism of a first compression stage and to compress the compressed gas to higher pressure by using a piston-cylinder mechanism of a second compression stage, wherein the piston of the second compression stage comprises:

a piston ring groove disposed at an outer periphery of the piston; and a piston ring mounted in the piston ring groove, the piston ring sealing a space between the piston and the cylinder, wherein a ring groove other than the piston ring groove is provided at the outer periphery of the piston on a side away from the piston ring groove and closer to a crank shaft, a guide ring is mounted in the ring groove in such a manner that the guide ring cannot move radially, within the ring groove, from an initial guide ring position, to thereby suppresses radial movement of the piston when the piston is tilted with respect to the cylinder, and the initial guide ring position is a radial position at which the guide ring is installed in the ring groove between the piston and the cylinder.

17. The reciprocating compressor according to claim 16, wherein the piston of the first compression stage is mounted with a lip ring.

18. The reciprocating compressor according to claim 16, wherein the piston of the first compression stage is mounted with a piston ring.

19. The reciprocating compressor according to claim 18, wherein the piston of the first compression stage is mounted with a guide ring.

20. The reciprocating compressor according to claim 1, wherein the guide ring cannot undergo any radial movement within the ring groove.

* * * * *